US009099053B2

(12) United States Patent
Matsumoto et al.

(10) Patent No.: US 9,099,053 B2
(45) Date of Patent: Aug. 4, 2015

(54) CONTROL CIRCUIT FOR DISPLAY DEVICE

(75) Inventors: Shuuichirou Matsumoto, Mobara (JP); Mitsuru Goto, Chiba (JP)

(73) Assignees: JAPAN DISPLAY INC., Tokyo (JP); PANASONIC LIQUID CRYSTAL DISPLAY CO., LTD., Hyogo-Ken (JP)

( * ) Notice: Subject to any disclaimer, the term of this patent is extended or adjusted under 35 U.S.C. 154(b) by 768 days.

(21) Appl. No.: 13/031,929

(22) Filed: Feb. 22, 2011

(65) Prior Publication Data

US 2011/0205212 A1 Aug. 25, 2011

(30) Foreign Application Priority Data

Feb. 22, 2010 (JP) ..... 2010-036708

(51) Int. Cl.
*G09G 5/00* (2006.01)
*G09G 3/36* (2006.01)

(52) U.S. Cl.
CPC ..... *G09G 3/3677* (2013.01); *G09G 2310/0286* (2013.01); *G09G 2320/041* (2013.01)

(58) Field of Classification Search
CPC ..... G09G 3/36; G09G 3/30; G09G 5/00; H03K 17/14
USPC ..... 345/100, 211
See application file for complete search history.

(56) References Cited

U.S. PATENT DOCUMENTS

| | | | | |
|---|---|---|---|---|
| 4,319,237 | A * | 3/1982 | Matsuo et al. | 345/101 |
| 2007/0070020 | A1 | 3/2007 | Edo et al. | |
| 2007/0164946 | A1 * | 7/2007 | Akutsu et al. | 345/87 |
| 2007/0182695 | A1 * | 8/2007 | Shimizu | 345/101 |
| 2008/0258998 | A1 | 10/2008 | Miyake | |
| 2009/0102779 | A1 * | 4/2009 | Jo | 345/101 |

FOREIGN PATENT DOCUMENTS

| | | |
|---|---|---|
| JP | 2007-95190 | 4/2007 |
| JP | 2008-122939 | 5/2008 |

* cited by examiner

*Primary Examiner* — Tony N Ngo
(74) *Attorney, Agent, or Firm* — Lowe Hauptman & Ham, LLP

(57) ABSTRACT

A control circuit for a display device includes a shift register circuit which includes at least one transistor and outputs a gate signal in response to at least one voltage signal, a temperature information acquisition unit configured to acquire temperature information at the control circuit for a display device, and a voltage switching unit configured to switch a voltage of the at least one voltage signal based on the acquired temperature information.

10 Claims, 9 Drawing Sheets

Vn
Vn+2
Vn+4
Vn+6
VGL
VGH
VST1
IN5
IN2
IN1
OUT2
IN3
OUT
120
IN6
IN4
113-1
113-3
113-5
113-7
113-2
113-4
113-6
113-8
T4AG
T3G
T5D
N1
VGL
T10G
VGH
TIG
Gn
T9G
Gn+1
Gn+2
Gn+3
Gn+4
Gn+5
Gn+6
Gn+7
VST2
Vn+7
Vn+5
Vn+3
Vn+1

CONTROL CIRCUIT FOR DISPLAY DEVICE

CROSS-REFERENCE TO RELATED APPLICATION

The present application claims priority from Japanese application JP 2010-036708 filed on Feb. 22, 2010, the content of which is hereby incorporated by reference into this application.

BACKGROUND OF THE INVENTION

1. Field of the Invention

The present invention relates to a control circuit for a display device.

2. Description of the Related Art

With respect to a conventional liquid crystal display device, there has been adopted a so-called shift register built-in display system where a shift register circuit provided to a gate signal line drive circuit for scanning gate signal lines is formed on the same substrate on which thin film transistors (hereinafter referred to as TFT) are arranged in a pixel region of a display screen. JP 2007-95190 A and JP 2008-122939 A disclose such a shift register built-in display device of the related art.

SUMMARY OF THE INVENTION

However, in the above-mentioned shift register built-in display device, when a temperature becomes low, an ON current for a transistor included in the shift register circuit is decreased so that the transistor may not properly be operated and a proper gate signal cannot be supplied.

One or more embodiments of the present invention has been made under such circumstances, and it is an object of one or more embodiments of the present invention to provide a display device control circuit which can supply a proper gate signal particularly at a low temperature by acquiring temperature information and by switching a voltage amplitude of a Low voltage line and/or a voltage amplitude of a High voltage line with respect to a gate control signal based on the acquired temperature information.

According to one aspect of the present invention, a control circuit for a display device includes a shift register circuit which includes at least one transistor and outputs a gate signal in response to at least one voltage signal, a temperature information acquisition unit configured to acquire temperature information at the control circuit for a display device, and a voltage switching unit configured to switch a voltage of the at least one voltage signal based on the acquired temperature information.

According to one or more embodiments of the present invention, the control circuit for a display device further includes a first threshold value storing unit configured to store a first threshold temperature. The voltage switching unit switches a voltage of the at least one voltage signal when the acquired temperature information indicates that a temperature becomes a temperature lower than the first threshold temperature from a temperature higher than the first threshold temperature.

According to one or more embodiments of the present invention, the control circuit for a display device further includes a second threshold value storing unit configured to store a second threshold temperature. The voltage switching unit switches a voltage of the at least one voltage signal to a voltage of the at least one voltage signal outputted before switching when the acquired temperature information indicates that a temperature becomes a temperature higher than the second threshold temperature from a temperature lower than the second threshold temperature.

According to one or more embodiments of the present invention, the control circuit for a display device further includes a shift voltage storing unit configured to store a shift voltage. The voltage switching unit switches the voltage of the at least one voltage signal to a voltage that is changed from the voltage of the at least one voltage signal by an amount of the shift voltage.

According to one or more embodiments of the present invention, the voltage signal includes a voltage signal of a Low voltage line.

According to one or more embodiments of the present invention, the voltage signal includes a voltage signal of a High voltage line.

According to one or more embodiments of the present invention, the at least one voltage signal includes a voltage signal of a Low voltage line and a voltage signal of a High voltage line. The control circuit for a display device further includes a first threshold value storing unit configured to store a first threshold temperature. The voltage switching unit switches the voltage of the at least one voltage signal such that a voltage of the voltage signal of the Low voltage line is lowered and a voltage of the voltage signal of the High voltage line is elevated when the acquired temperature information indicates that a temperature becomes a temperature lower than the first threshold temperature from a temperature higher than the first threshold temperature.

According to one or more embodiments of the present invention, the control circuit for a display device further includes a second threshold value storing unit configured to store a second threshold temperature. The voltage switching unit respectively switches the voltage of the voltage signal of the Low voltage line and the voltage of the voltage signal of the High voltage line to the voltage of the voltage signal of the Low voltage line outputted before switching and the voltage of the voltage signal of the High voltage line outputted before switching when the acquired temperature information indicates that a temperature becomes a temperature higher than the second threshold temperature from a temperature lower than the second threshold temperature.

According to one or more embodiments of the present invention, the control circuit for a display device further includes a common voltage switching unit configured to switch a voltage of a common signal line in a pixel region based on the acquired temperature information.

According to one or more embodiments of the present invention, the control circuit for a display device further includes a first threshold value storing unit configured to stores a first threshold temperature. The common voltage switching unit switches a voltage of the common signal line when the acquired temperature information indicates that a temperature becomes a temperature lower than the first threshold temperature from a temperature higher than the first threshold temperature.

According to one or more embodiments of the present invention, the control circuit for a display device further includes a second threshold value storing unit which stores a second threshold temperature. The common voltage switching unit switches the voltage of the common signal line to the voltage of the common signal line outputted before switching the voltage of the common signal line when the acquired temperature information indicates that a temperature becomes a temperature higher than the second threshold temperature from a temperature lower than the second threshold temperature.

According to one or more embodiments of the present invention, the control circuit for a display device further includes a common shift voltage storing unit which stores a common shift voltage of the common signal line. The common voltage switching unit switches the voltage of the common voltage signal to a voltage which is changed from the voltage of the common voltage signal by an amount corresponding to the common shift voltage.

DETAILED DESCRIPTION OF THE INVENTION

Figure 1:
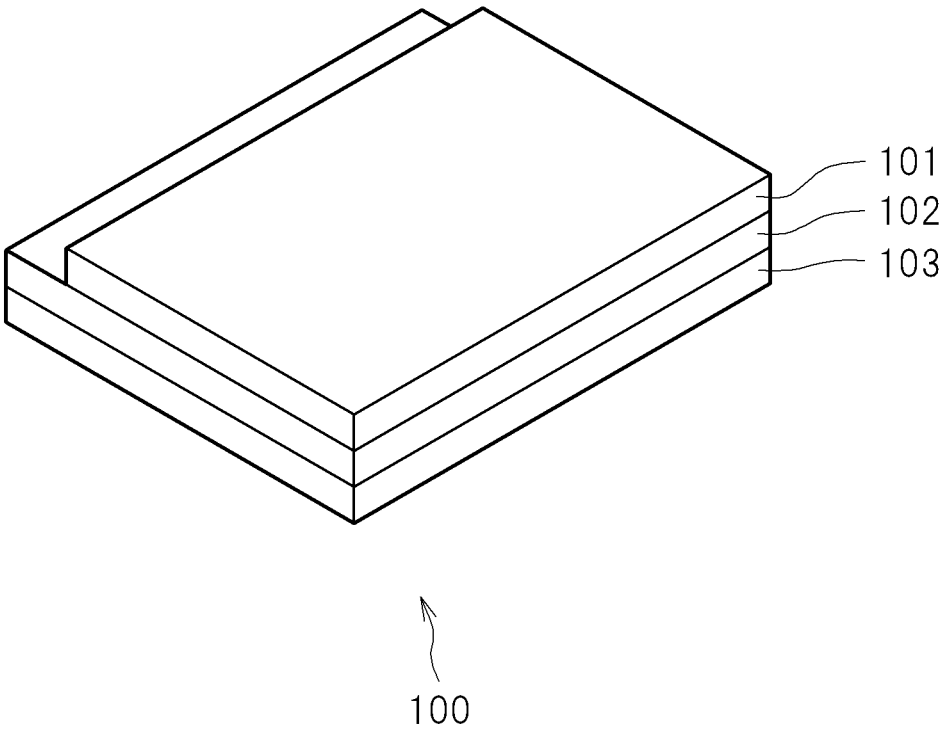
FIG. 1 is a schematic view showing a display device according to an embodiment of the present invention.

FIG. 1 is a schematic view showing a display device according to an embodiment of the present invention. As shown in FIG. 1, for example, a display device 100 includes a TFT substrate 102 on which TFTs and the like (not shown in the drawing) are formed, and a filter substrate 101 which faces the TFT substrate 102 in an opposed manner and on which color filters (not shown in the drawing) are formed. Further, the display device 100 includes a liquid crystal material (not shown in the drawing) which is sealed in an area sandwiched between the TFT substrate 102 and the filter substrate 101, and a backlight 103 which is arranged on the TFT substrate 102 on a side opposite to the filter substrate 101 in a state where the backlight 103 is brought into contact with the TFT substrate 102.

Figure 2:
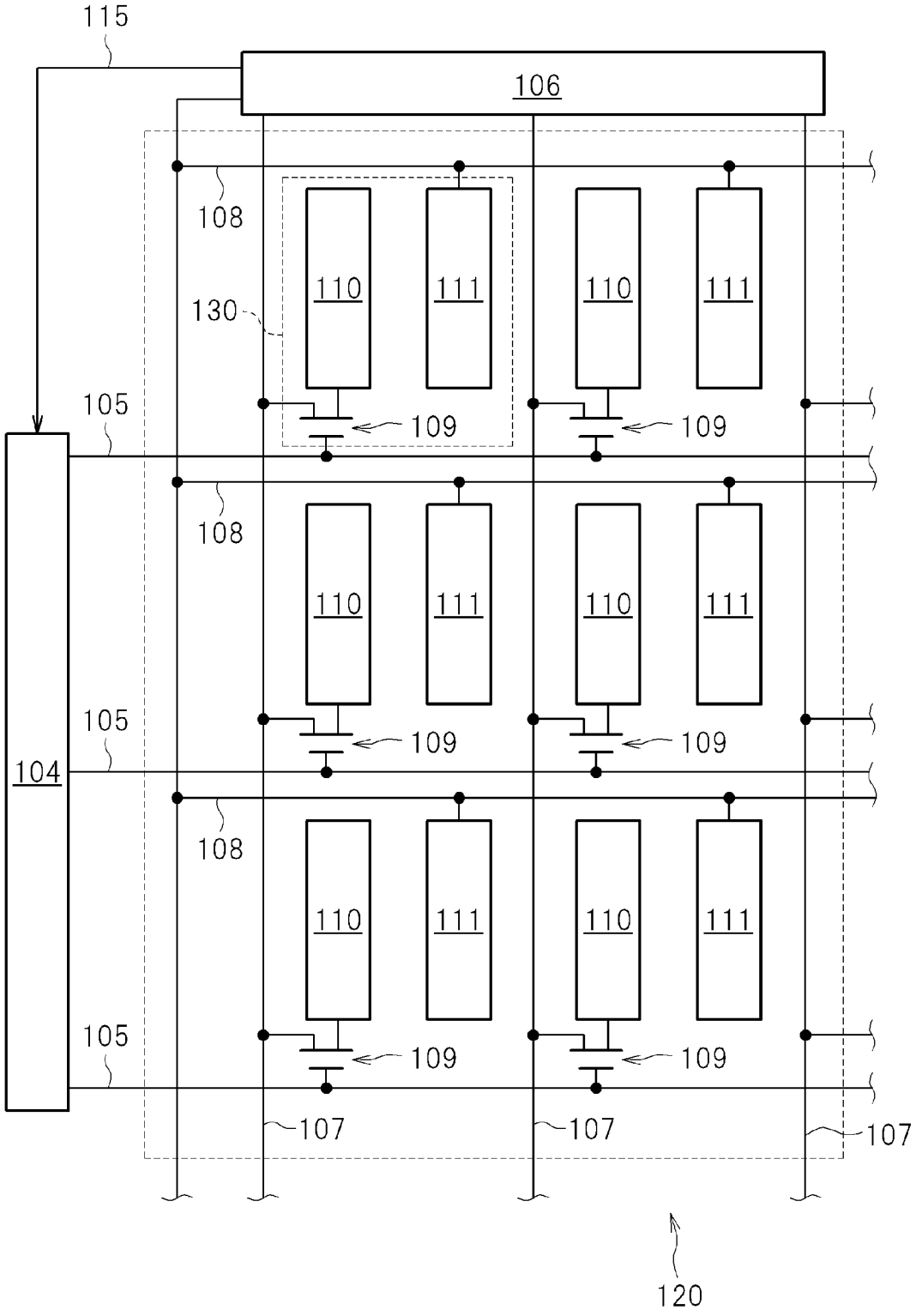
FIG. 2 is a conceptual view of a pixel circuit which is formed on a TFT substrate shown in FIG. 1.

FIG. 2 is a conceptual view of a pixel circuit which is formed on the TFT substrate 102. As shown in FIG. 2, the TFT substrate 102 includes a plurality of gate signal lines 105 which extend in the lateral direction and are arranged parallel to each other in the longitudinal direction at substantially equal intervals in FIG. 2, and a plurality of video signal lines 107 which extend in the longitudinal direction and are arranged parallel to each other in the lateral direction at substantially equal intervals in FIG. 2. Further, the gate signal lines 105 are connected to a shift register circuit 104, and the video signal lines 107 are connected to a driver 106.

The shift register circuit 104 includes a plurality of basic circuits (not shown in the drawing) which correspond to the plurality of gate signal lines 105 respectively. Each basic circuit outputs, in response to a control signal 115 from the driver 106, a gate signal which has a High voltage during a gate scanning period (signal High period) corresponding to the control signal 115 and has a Low voltage during a period (signal Low period) other than the gate scanning period within one frame period to corresponding gate signal line 105. The shift register circuit 104 is described in detail later.

Each one of pixel regions 130 includes a TFT 109, a pixel electrode 110 and a common electrode 111. Each one of pixel regions 130 are arranged in a matrix array by the gate signal lines 105 and the video signal lines 107. Here, a gate of the TFT 109 is connected to the gate signal line 105, and one of a source and a drain of the TFT 109 is connected to the video signal line 107, and the other of the source and the drain of the TFT 109 is connected to the pixel electrode 110. The common electrodes 111 are connected to common signal lines 108. Here, the pixel electrode 110 and the common electrode 111 face each other in an opposed manner.

Next, an operation of the pixel circuit having the above-mentioned constitution is explained. The driver 106 applies a reference voltage to the common electrode 111 via the common signal line 108. The shift register circuit 104 which is controlled by the driver 106 outputs a gate signal to the gate electrode of the TFT 109 via the gate signal line 105. The driver 106 supplies a voltage of a video signal to the TFT 109 to which the gate signal is outputted via the video signal line 107, and the voltage of the video signal is applied to the pixel electrode 110 via the TFT 109. Here, a potential difference is generated between the pixel electrode 110 and the common electrode 111.

The driver 106 controls the potential difference generated between the pixel electrode 110 and the common electrode 111 so that the distribution of light or the like in liquid crystal molecules of the liquid crystal material which is inserted between the pixel electrode 110 and the common electrode 111 can be controlled. Here, light irradiated from the backlight 103 is guided through the liquid crystal material, and hence, by controlling the distribution of light or the like in the liquid crystal molecules as described above, a quantity of light irradiated from the backlight 103 can be adjusted so that an image can be displayed on a display screen.

Figure 3:
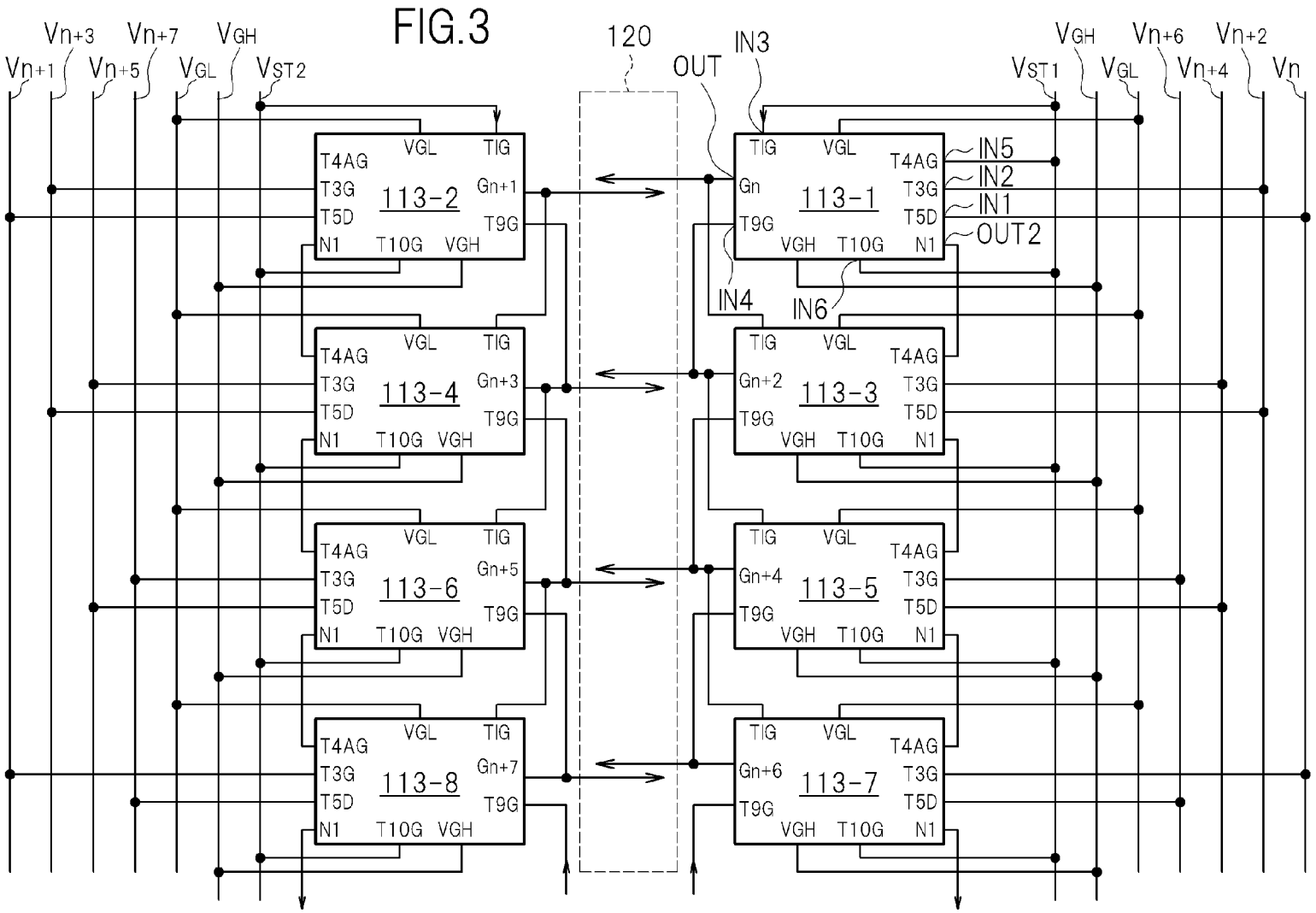
FIG. 3 is a block diagram of a shift resister circuit shown in FIG. 2.

FIG. 3 is a block diagram of the shift register circuit 104. In FIG. 3, an nth basic circuit is expressed as a basic circuit 113-*n*. As shown in FIG. 3, the shift register circuit 104 has odd-numbered basic circuits 113 on a right side in the drawing and even-numbered basic circuits 113 on a left side in the drawing. Further, the shift register circuit 104 includes a pixel region 120 between the odd-numbered basic circuits 113 and the even-numbered basic circuits 113, and outputs gate signals $G_n$ which correspond to the plurality of gate lines 105 respectively. This constitution is explained in detail later. The pixel region 120 corresponds to a region arranged between the shift register circuits 104 that are arranged on both ends of the above-mentioned pixel circuit shown in FIG. 2.

Each basic circuit 113 has, as shown in FIG. 3 as the basic circuit 113-1, for example, input terminals IN1, IN2, IN3, IN4, IN5, IN6 and output terminals OUT, OUT2. The driver 106 outputs the control signal 115 to the input terminals IN1, IN2, IN3, IN4, IN5, IN6.

Here, a control signal 115 includes, for example, 4-phase basic clock signals $V_n$, $V_{n+2}$, $V_{n+4}$, $V_{n+6}$ having phases different from each other, a voltage of a High voltage line $V_{GH}$, a voltage of a Low voltage line $V_{GL}$ and an auxiliary signal $V_{ST1}$, which are inputted to the odd-numbered basic circuits 113. Alternatively, a control signal 115 includes, for example, 4-phase basic clock signals $V_{n+1}$, $V_{n+3}$, $V_{n+5}$, $V_{n+7}$ having phases different from each other, a voltage of a High voltage line $V_{GH}$, a voltage of a Low voltage line $V_{GL}$ and an auxiliary signal $V_{ST2}$, which are inputted to the even-numbered basic circuits 113.

Then, for example, to the input terminals IN1, IN2 of the nth basic circuit 113-*n*, the basic clock signals $V_n$, $V_{n+2}$ are inputted respectively. To the input terminal IN3 of the nth basic circuit 113-*n*, a gate signal $G_{n-2}$ from the (n−2)th basic circuit 113-(*n*−2) is inputted, and to the input terminal IN4 of the nth basic circuit 113-*n*, a gate signal $G_{n+2}$ from the (n+2)th basic circuit 113-(*n*+2) is inputted.

There are no corresponding gate signals to be applied to the input terminal IN3 of the first basic circuit 113-1 and the input terminal IN3 of the second basic circuit 113-2 and hence, auxiliary signals $V_{ST1}$, $V_{ST2}$ are inputted to these input terminals IN3 respectively. In the same manner, for example, assuming that there are 800 basic circuits, to the input terminal IN4 of the 799th basic circuit 113-799 and the input terminal IN4 of the 800th basic circuit 113-800, a gate signal $G_{801}$ from a 801st dummy circuit and a gate signal $G_{802}$ from a 802nd dummy circuit are inputted respectively, and to the input terminal IN4 of the 801st dummy circuit 113-801 and the input terminal IN4 of the 802nd dummy circuit 113-802, auxiliary signals $V_{ST1}$, $V_{ST2}$ are inputted respectively.

To the input terminal IN5 of the nth basic circuit 113-*n*, an output signal from the output terminal OUT2 of the (n−2)th basic circuit 113-(*n*−2) is inputted. There is no voltage at a node N1 to be applied to the input terminal IN5 of the first basic circuit 113-1 and the input terminal IN5 of the second basic circuit 113-2 and hence, auxiliary signals $V_{s11}$, $V_{sT2}$ are inputted respectively.

An auxiliary signal $V_{ST1}$ is inputted to the input terminal IN6 of the nth basic circuit 113-*n* when n is an odd number, and an auxiliary signal $V_{ST2}$ is inputted to the input terminal IN6 of the nth basic circuit 113-*n* when n is an even number.

On the other hand, a gate signal $G_n$ of the nth basic circuit 113-*n* is outputted from the output terminal OUT of the nth basic circuit 113-*n*. Further, a voltage at the node N1 of the nth basic circuit 113-*n* is outputted from the output terminal OUT2 of the nth basic circuit 113-*n*.

Figure 4:
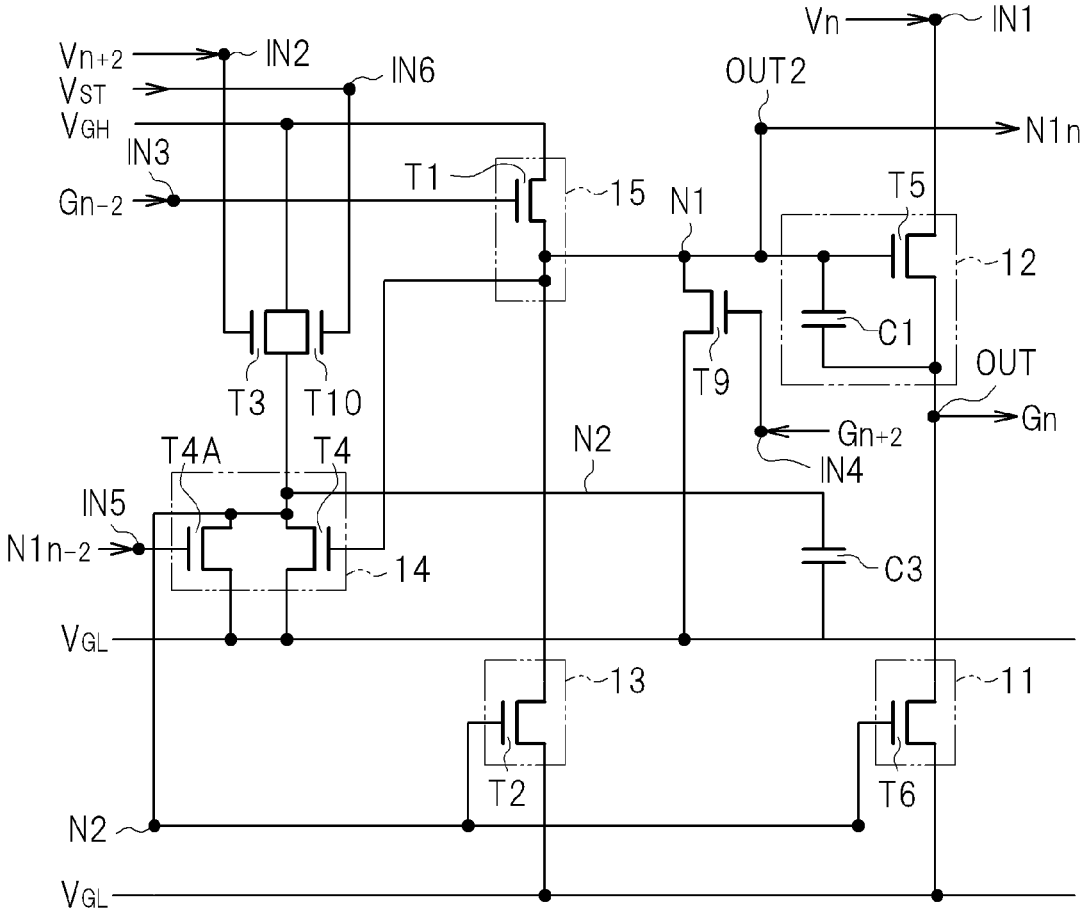
FIG. 4 is a circuit diagram of an nth basic circuit shown in FIG. 3.
Figure 5:
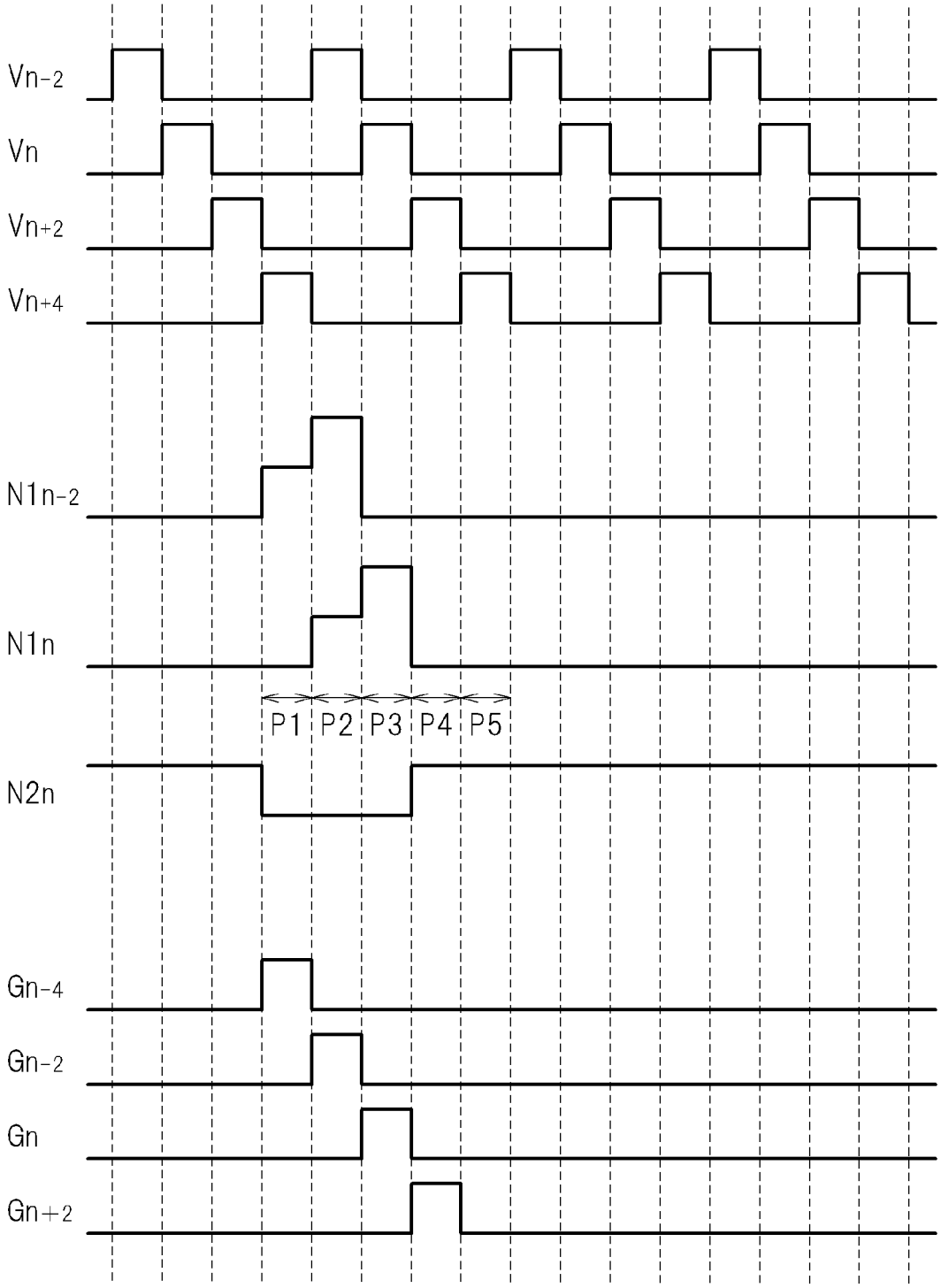
FIG. 5 is a timing chart showing a change with time of voltages at nodes N1, N2 of an nth basic circuit 113-*n* in the embodiment of the present invention.

FIG. 4 is a circuit diagram of the nth basic circuit. FIG. 5 is a timing chart which shows a change with time of voltages at nodes N1, N2 of the nth basic circuit 113-*n* together with voltages of basic clock signals which are input signals, voltages of gate signals of the basic circuit 113 and a voltage at the node N1. Hereinafter, the constitution and the manner of operation of the basic circuit 113 are explained along with the change with time of the voltages of the respective signals shown in FIG. 5.

As shown in FIG. 4, the input terminal IN5 is connected to a gate of a transistor T4A, and a voltage $N1_{n-2}$ at the node N1, which the output terminal OUT2 of the (n−2)th basic circuit 113-(*n*−2) outputs is inputted to the input terminal IN5. In the transistor T4A, during a period P1 shown in FIG. 5, the voltage $N1_{n-2}$ at the node N1 of the (n−2) th basic circuit 113-(*n*−2) becomes a High voltage so that the transistor T4A is turned on during the period P1. When the transistor T4A is turned on, the Low voltage line $V_{GL}$ is connected to an input side of the transistor T4A so that a Low voltage of the Low voltage line $V_{GL}$ is applied to a node N2.

The input terminal IN3 is connected to a gate of a transistor T1 which is included in a High voltage supply circuit 15. Accordingly, a gate signal $G_{n-2}$ of the (n−2)th basic circuit 113-(*n*−2) is inputted to the input terminal IN3. In the transistor T1, the gate signal $G_{n-2}$ of the (n−2)th basic circuit 113-(*n*−2) becomes a High voltage during a period P2 shown in FIG. 5 so that the transistor T1 is turned on during the period P2. When the transistor T1 is turned on, the High voltage line $V_{GH}$ is connected to an input side of the transistor T1 so that a High voltage of the High voltage line $V_{GH}$ is applied to the node N1.

During the period P2, as shown in FIG. 5, the voltage $N1_{n-2}$ at the node N1 of the (n−2)th basic circuit 113-(*n*−2) is held at a High voltage and hence, the transistor T4A is held in an ON state. Further, during the period P2, a transistor T4 is also turned on. This is because the node N1 is connected to a gate of the transistor T4 which is included in a Low voltage supply circuit 14 so that the node N1 becomes a High voltage during the period P2. As described above, both two transistors T4, T4A are turned on during the period P2. Accordingly, a Low voltage of the Low voltage line $V_{GL}$ is applied to the node N2. This is because the Low voltage line $V_{GL}$ is connected to an input side of the transistor T4 and an input side of the transistor T4A.

A High voltage applying switching circuit 12 includes a transistor T5. The input terminal IN1 is connected to an input side of the transistor T5, and a basic clock signal $V_n$ is inputted to the input terminal IN1. Here, the node N1 is held at a High voltage during a period P3 and hence, the transistor T5 is held in an ON state. Accordingly, as shown in FIG. 5, the basic clock signal $V_n$ becomes a High voltage during the period P3 which is a signal High period and hence, a gate signal $G_n$ which becomes a High voltage is outputted from the output terminal OUT during the period P3.

However, in an actual operation, due to a presence of a threshold voltage $V_{th}$ in the transistor T1, during the period P2, a voltage at the node N1 becomes a voltage obtained by subtracting the threshold voltage $V_{th}$ of the transistor T1 from a High voltage of the High voltage line $V_{GH}$. There may be a case where this voltage cannot sufficiently turn on the transistor T5 during the period P3 which is a signal High period.

In view of above, in the High voltage applying switching circuit 12, a boosting capacitance C1 is connected parallel to the transistor T5. With the use of the boosting capacitance C1, although the gate signal $G_{n-2}$ is changed to a Low voltage and the transistor T1 is turned off during the period P3, the node N1 can be held at a High voltage and hence, the transistor T5 can be held in an ON state. Here, a High voltage of the basic clock signal $V_n$ which is inputted to the input terminal IN1 is applied to the output terminal OUT so that a voltage at the node N1 can be boosted to a higher voltage due to capacitive coupling of the boosting capacitance C1. This boosted voltage is a so-called bootstrap voltage, and the transistor T5 can be sufficiently turned on by the bootstrap voltage.

Further, during the period P3, as shown in FIG. 5, a voltage $N1_{n-2}$ at the node N1 of the (n−2)th basic circuit 113-(*n*−2)

becomes a Low voltage so that the transistor T4A is turned off. However, the node N1 of the nth basic circuit 113-*n* is boosted by the bootstrap voltage and becomes a High voltage, and the transistor T4 which is provided to the node N2 Low voltage supply circuit 14 is held in an ON state. Accordingly, even after the transistor T4A is turned off, a voltage at the node N2 is held at a Low voltage.

The Low voltage line $V_{GL}$ is connected to an input side of a transistor T9. Further, the input terminal IN4 is connected to a gate of the transistor T9, and a gate signal $G_{n+2}$ from the (n+2)th basic circuit 113-(*n*+2) is inputted to the input terminal IN4.

Here, as shown in FIG. 5, during a period P4, the gate signal $G_{n+2}$ becomes a High voltage so that the transistor T9 is turned on. Accordingly, a Low voltage of the Low voltage line $V_{GL}$ is applied to the node N1. Due to such an operation, the transistor T5 is turned off. The transistor T4 is also turned off simultaneously.

Further, as shown in FIG. 4, a holding capacity C3 and a transistor T3 are connected between the Low voltage line $V_{GL}$ and the High voltage line $V_{GH}$ in series. An output terminal of the transistor T3 and a positive pole of the holding capacity C3 are connected to the node N2. The Low voltage line $V_{GL}$ is connected to a negative pole of the holding capacity C3, and the High voltage line $V_{GH}$ is connected to an input side of the transistor T3 respectively. The input terminal IN2 is connected to a gate of the transistor T3, and a basic clock signal $V_{n+2}$ is inputted to the input terminal IN2.

Here, the basic clock signal $V_{n+2}$ becomes a High voltage during the period P4 so that the transistor T3 is turned on during the period P4 so that a voltage of the node N2 is changed to a High voltage. Simultaneously, the holding capacity C3 is charged with a High voltage.

During a period P5, the basic clock signal $V_{n+2}$ becomes a Low voltage so that the transistor T3 is turned off. However, a voltage at the node N2 is held at a High voltage due to the holding capacity C3. Further, the basic clock signal $V_{n+2}$ periodically becomes a High voltage and continues charging of the holding capacity C3 periodically and hence, a voltage at the node N2 can be held at a High voltage in a stable manner.

Further, as shown in FIG. 4, the nth basic circuit 113-*n* includes a transistor T10 which is arranged parallel to the transistor T3. The input terminal IN6 is connected to a gate of the transistor T10, and the above-mentioned auxiliary signal $V_{sT}$ is inputted to the input terminal IN6. Accordingly, the transistor T3 is periodically turned on so that the holding capacity C3 is continued to be periodically charged. Further, the transistor T10 is turned on every time the auxiliary signal $V_{ST}$ becomes a High voltage and so that the holding capacity C3 is also charged.

Here, as described above, an auxiliary signal $V_{ST}$ indicates an auxiliary signal $V_{ST1}$ when n is an odd number and indicates an auxiliary signal $V_{ST2}$ when n is an even number. The nth basic circuit 113-*n* where n is an odd number charges the holding capacity C3 at timing that the auxiliary signal $V_{ST1}$ becomes a High voltage, and the nth basic circuit 113-*n* where n is an even number charges the holding capacity C3 at timing that the auxiliary signal $V_{ST2}$ becomes a High voltage simultaneously via the transistor T10 in the respective basic circuits 113. Accordingly, for example, the auxiliary signal $V_{ST}$ becomes a High voltage during a retracing period which is a time other than a period for writing data in a display area within one frame period, so that the node N2 can be held at a High voltage in a more stable manner.

As described above, a High voltage, which is a voltage of the basic clock signal $V_n$, is outputted from the output terminal OUT only during the period P3, and a Low voltage is outputted from the output terminal OUT during other periods.

Specifically, during the periods P2, P3, a voltage at the node N1 becomes a High voltage so that the transistor T5, which is a High voltage applying switching element, is turned on. During these periods, a voltage of the basic clock signal $V_n$ is outputted from the output terminal OUT as a gate signal $G_n$. In the period P3, the basic clock signal $V_n$ becomes a High voltage and hence, a voltage of the gate signal $G_n$ also becomes a High voltage in this period. In the periods P1, P2, P3, a voltage at the node N2 becomes a Low voltage so that the transistor T6, which is a Low voltage applying switching element, and the transistor T2, which is a switching signal supply switching element, are tuned off.

On the other hand, in periods other than the periods P1, P2, P3 within one frame period, a voltage at the node N2 is held at a High voltage, the transistor T2 is turned on, and a voltage at the node N1 is held at a Low voltage. Here, the transistor T6 is turned on so that a Low voltage of the Low voltage line $V_{GL}$ is outputted from the output terminal OUT as a gate signal G.

As described above, in this embodiment, a voltage at the node N2 of the nth basic circuit 113-*n* is changed from a High voltage to a Low voltage in response to the signal High period using a voltage $N1_{n-2}$ at the node N1 of the (n−2)th basic circuit 113-(*n*−2), which is an internal signal, instead of an external signal such as a gate signal $G_{n-2}$ of the (n−2) th basic circuit 113-(*n*−2) which is directly connected to the outside of the shift register circuit 104 as arranged in the display area.

Here, a voltage $N1_{n-2}$ at the node N1 is outputted from the output terminal OUT2 of the (n−2)th basic circuit 113-(*n*−2), and is inputted to the input terminal IN5 of the nth basic circuit 113-*n*. However, the voltage $N1_{n-2}$ at the node N1 is not outputted to the outside of the shift register circuit 104 and is not directly connected to the outside. That is, it is say that the voltage $N1_{n-2}$ at the node N1 is an internal signal of the shift register circuit 104.

In this manner, by changing the voltage at the node N2 of the nth basic circuit 113-*n* from the High voltage to the Low voltage in response to the signal High period using the internal signal of the shift register circuit 104 such as the voltage at the node N1, which is not directly connected to the outside, instead of the external signal such as the gate signal to which a noise signal is applied from the outside, it is possible to prevent the node N2 from being influenced by the noise signal generated outside. Due to such a constitution, it is possible to suppress noises of a gate signal outputted from the gate signal line drive circuit which includes the shift register circuit 104. As a result, it is possible to enhance the display quality of the display device which includes the gate signal line drive circuit.

Here, FIG. 3 to FIG. 5 show one example of the constitution and the manner of operation of the basic circuit 113 which constitutes apart of the shift register circuit 104. Accordingly, each basic circuit may have the constitution different from the above-mentioned constitution provided that the basic circuit outputs, in response to a control signal 115 from the driver 106, a gate signal which becomes a High voltage during a gate scanning period (signal High period) in response to the control signal 115 and becomes a Low voltage during a period (signal Low period) other than the gate scanning period within one frame period to corresponding gate signal line 105.

Figure 6:
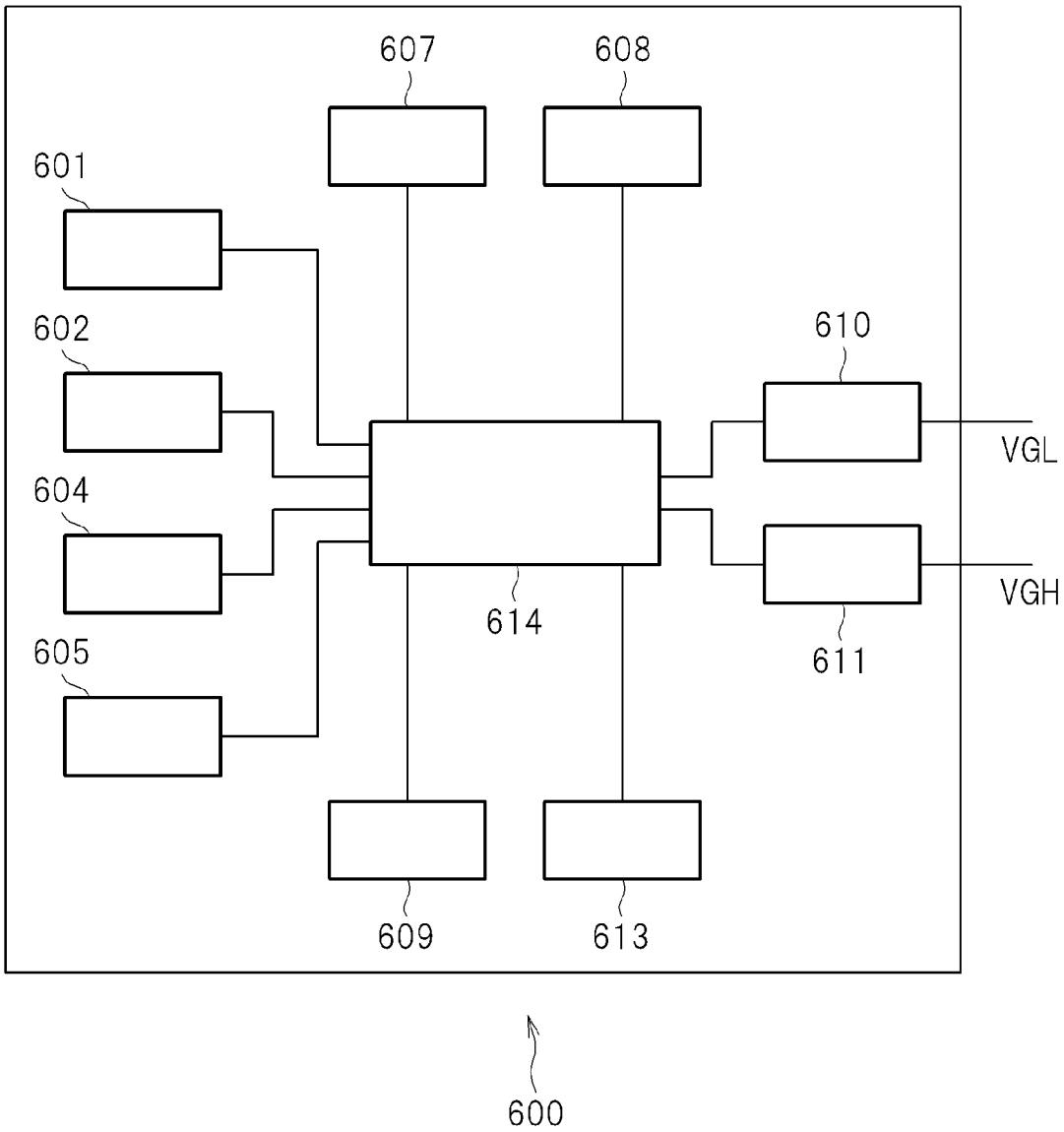
FIG. 6 is a block diagram schematically showing a voltage switching part in the embodiment of the present invention.

FIG. 6 is a schematic view showing a voltage switching part of this embodiment which switches a voltage value of a Low voltage and a voltage value of a High voltage. As shown in FIG. 6, a voltage switching part 600 includes a GLFB storing part 601, a GHFB storing part 602, a VGLSFT storing part 604, a VGHSFT storing part 605, a UTP storing part 607, a DTP storing part 608, a TSDC storing part 609, a Low voltage switching part 610, a High voltage switching part 611, a temperature acquisition part 613, and a control part 614. The control part 614 is connected to the temperature acquisition part 613, the respective voltage switching parts 610 and the like, and the respective storing parts 601 and the like. The voltage switching part 600 may be integrally built in the inside of the driver 106 or may be formed separately from the driver 106.

In the explanation made hereinafter, it is assumed that a High voltage and a Low voltage indicated in the basic circuit 113 of the shift register circuit 104 correspond to, except for the above-mentioned bootstrap voltage, a Low voltage of a Low voltage line $V_{GL}$ and a High voltage of a High voltage line $V_{GH}$ described below. For example, the Low voltage and the High voltage in the basic circuit 113 of the above-mentioned shift register circuit 104 are respectively substantially equal to a Low voltage of the Low voltage line $V_{GL}$, a High voltage of the High voltage line $V_{GH}$, and a Low voltage of basic clock signals $V_n$ and a High voltage and the like.

The GLFB storing part 601 stores a set voltage (VGL set voltage) of the Low voltage line $V_{GL}$, and outputs the VGL set voltage to the control part 614. For example, as shown in Table 1, the GLFB storing part 601 stores set voltages of plurality of Low voltage lines $V_{GL}$, the set voltages of the plurality of Low voltage lines $V_{GL}$ respectively correspond to respective register values. For example, in Table 1, a register value 5'h7 corresponds to a VGL set voltage −10V. Which set voltage of the Low voltage line $V_{GL}$ is to be selected is determined by selecting the register value from the above-mentioned respective register values at the time of shipping a product from a factory, for example.

TABLE 1

| GLFB register | VGL set voltage(V) |
|---|---|
| 5'h0 | −6.5 |
| 5'h1 | −7 |
| 5'h2 | −7.5 |
| 5'h3 | −8 |
| 5'h4 | −8.5 |
| 5'h5 | −9 |
| 5'h6 | −9.5 |
| 5'h7 | −10 |
| 5'h8 | −10.5 |
| 5'h9 | −11 |
| 5'hA | −11.5 |
| 5'hB | −12 |
| 5'hC | −12.5 |
| 5'hD | −13 |
| 5'hE | −13.5 |
| 5'hF | −14 |
| 5'h10 | −14.5 |
| 5'h11 | −15 |
| 5'h12 | −15.5 |
| 5'h13 | −16 |
| 5'h14 | −16.5 |
| 5'h15 | −17 |
| 5'h16 | −17.5 |
| 5'h17 | −18 |

The GHFB storing part 602 stores a set voltage (VGH set voltage) of the High voltage line $V_{GH}$, and outputs the VGH set voltage to the control part 614. For example, as shown in Table 2, the GHFB storing part 602 stores set voltages of a plurality of High voltage lines $V_{GH}$, the set voltages of the plurality of High voltage lines $V_{GH}$ respectively correspond to respective register values. For example, in Table 2, a register value 5'h4 corresponds to a VGH set voltage 18V. Which set voltage of the High voltage line $V_{GH}$ is to be selected is determined by selecting the register value from the respective register values at the time of shipping a product from a factory, for example.

TABLE 2

| GHFB register | VGH set voltage(V) |
|---|---|
| 5'h0 | 20 |
| 5'h1 | 19.5 |
| 5'h2 | 19 |
| 5'h3 | 18.5 |
| 5'h4 | 18 |
| 5'h5 | 17.5 |
| 5'h6 | 17 |
| 5'h7 | 16.5 |
| 5'h8 | 16 |
| 5'h9 | 15.5 |
| 5'hA | 15 |
| 5'hB | 14.5 |
| 5'hC | 14 |
| 5'hD | 13.5 |
| 5'hE | 13 |
| 5'hF | 12.5 |
| 5'h10 | 12 |
| 5'h11 | 11.5 |
| 5'h12 | 11 |
| 5'h13 | 10.5 |
| 5'h14 | 10 |

The DTP storing part 608 stores temperature dropping time threshold temperatures, and outputs these threshold temperatures to the control part 614. For example, as shown in Table 3, the DTP storing part 608 stores the plurality of temperature dropping time threshold temperatures, and the plurality of temperature dropping time threshold temperatures correspond to the respective register values. For example, in Table 3, the register value 4'h6 corresponds to the temperature dropping time threshold temperature −10° C. Which temperature dropping time threshold temperature is to be selected is determined by selecting the register value from the above-mentioned respective register values at the time of shipping a product from a factory, for example.

TABLE 3

| DTP register | temperature dropping time threshold temperature |
|---|---|
| 4'h0 | 20° C. |
| 4'h1 | 15° C. |
| 4'h2 | 10° C. |
| 4'h3 | 5° C. |
| 4'h4 | 0° C. |
| 4'h5 | −5° C. |
| 4'h6 | −10° C. |
| 4'h7 | −15° C. |
| 4'h8 | −20° C. |

The UTP storing part 607 stores temperature rising time threshold temperatures, and outputs these threshold temperatures to the control part 614. For example, as shown in Table 4, the UTP storing part 607 stores the plurality of temperature rising time threshold temperature as changes (temperatures to be added) in the row direction from the selected DTP register value. The changes correspond to the respective register values.

For example, the register value 0 corresponds to the temperature +5° C. with respect to the DTP register, and the register value 1 corresponds to the temperature +10° C. with respect to the DTP register. Which change is to be selected is determined by selecting either one of the above-mentioned register value 0 or the register value 1 at the time of shipping a product from a factory, for example.

TABLE 4

| UTP register | temperature rising time threshold temperature |
|---|---|
| 0 | DTP register +5° C. |
| 1 | DTP register +10° C. |

The TSDC storing part 609 stores information regarding whether a temperature acquisition function of the temperature acquisition part 613 is turned on or off, and the TSDC storing part 609 outputs the information to the control part 614. To be more specific, for example, as shown in Table 5, the register value 0 indicates that the temperature acquisition function of the temperature acquisition part 613 is turned off, and the register value 1 indicates that temperature acquisition function of the temperature acquisition part 613 is turned on. Setting of the register value may be performed at the time of shipping a product from a factory by selecting the above-mentioned register value. Alternatively when the display device 100 is mounted on a foldable mobile phone or the like, for example, the register value may be set to 1 from 0 at various timings such as timing at which the foldable mobile phone is opened or timing at which it is necessary for a user to observe a display screen.

TABLE 5

| TSDC register | temperature acquisition switching function |
|---|---|
| 0 | function turned off |
| 1 | function turned on |

The temperature acquisition part 613 is constituted of a bipolar transistor, a temperature sensor or the like, for example. The temperature acquisition part 613 acquires the temperature information at the voltage switching part 600 and outputs the temperature information to the control part 614. To be more specific, the temperature acquisition part 613 acquires the temperature information for every 1 frame period and outputs the temperature information to the control part 614, for example. Further, turning on or off of the temperature acquisition part 613 is selected by the control part 614 in response to the register value of the TSDC storing part 609. The temperature acquisition part 613 may be integrally formed with the voltage switching part 600 as shown in FIG. 6 or may be formed separately from the voltage switching part 600. Further, the acquisition of temperature information is not limited to every 1 frame period, and may be performed for every period different from 1 frame period.

The VGLSFT storing part 604 stores a change (VGL shift voltage) of a voltage of the Low voltage line $V_{GL}$ when the temperature information indicates that the temperature becomes lower than the temperature dropping time threshold temperature, and outputs the change to the control part 614. For example, as shown in Table 6, the VGLSFT storing part 604 stores changes of voltages of the plurality of Low voltage line $V_{GL}$, and the changes of voltages of the plurality of Low voltage lines $V_{GL}$ correspond to the respective register values. For example, in Table 6, the register value 3'h1 corresponds to a VGL set voltage −2V set based on the GLFB register value.

TABLE 6

| VGLSFT register | VGL shift voltage setting | |
|---|---|---|
| 3'h0 | −1 V | GLFB register value +2 steps |
| 3'h1 | −2 V | GLFB register value +4 steps |
| 3'h2 | −3 V | GLFB register value +6 steps |
| 3'h3 | −4 V | GLFB register value +8 steps |
| 3'h4 | 0 V | no VGL shift |

Which change of the voltage is to be selected from the changes of voltages of the plurality of Low voltage lines $V_{GL}$ is determined by selecting the register value from the respective register values at the time of shipping a product from a factory, for example. Further, as changes of voltages of the plurality of Low voltage lines $V_{GL}$, for example, as shown in a second column in Table 6, specific values may be stored. On the other hand, as shown in a third column in Table 6, the changes of voltages of a plurality of Low voltage lines $V_{GL}$ may be stored as changes (the number of steps) in the row direction from the selected GLFB register values.

The VGHSFT storing part 605 stores a change (VGH shift voltage) of a voltage of the High voltage lines $V_{GH}$ when the temperature information indicates that the temperature becomes lower than the temperature rising time threshold value, and outputs the change to the control part 614. For example, as shown in Table 7, the VGHSFT storing part 605 stores changes of voltages of the plurality of High voltage lines $V_{GH}$, and the changes of the voltages of the plurality of High voltage lines $V_{GH}$ correspond to the respective register values. For example, in Table 7, the register value 3'h1 corresponds to a VGH set voltage +2V set based on the GHFB register value.

TABLE 7

| VGHSFT register | VGH shift voltage setting | |
|---|---|---|
| 3'h0 | +1 V | GHFB register value −2 steps |
| 3'h1 | +2 V | GHFB register value −4 steps |
| 3'h2 | +3 V | GHFB register value −6 steps |
| 3'h3 | +4 V | GHFB register value −8 steps |
| 3'h4 | 0 V | no VGH shift |

Which change of the voltage is to be selected from the changes of voltages of the plurality of High voltage lines $V_{GH}$ is determined by selecting the register value from the respective register values at the time of shipping a product from a factory, for example. Further, as changes of voltages of the plurality of High voltage lines $V_{GH}$, for example, as shown in a second column in Table 7, specific values may be stored. Further, the changes of voltages of the plurality of High voltage lines $V_{GH}$ may be stored as changes (the number of steps) in the row direction from the selected GHFB register value. Further, the VGL shift voltage or the VGH shift voltage described above correspond to shift voltages described in claims.

The Low voltage switching part 610 switches a voltage for the Low voltage line $V_{GL}$ in response to a Low voltage control signal from the control part 614, and outputs the Low voltage obtained by switching to the Low voltage line $V_{GL}$. The High voltage switching part 611 switches a voltage for the High voltage line $V_{GH}$ in response to a High voltage control signal from the control part 614, and outputs the High voltage obtained by switching to the High voltage line $V_{GH}$.

Next, the manner of operation of the voltage switching part 600 is explained. To be more specific, for example, the explanation is made hereinafter with respect to a case where a VGH set voltage is set to 18V (GHFB register value being 5'h4), a VGL set voltage is set to −8V (GLFB register value being 5'h3), a temperature dropping time threshold temperature is set to −10° C. (DTP register value being 4'h6), a change of temperature rising time threshold temperature is set to 5° C. (UTP register value being 0, −10° C.+5° C.=−5° C.), a VGH shift voltage of the VGHSFT storing part 605 is set to +1V (VGHSFT register value being 3'h0), and a VGL shift voltage of the VGLSFT storing part 604 is set to −2V (VGLSFT register value being −3'h1, −2V shift).

When a temperature acquired by the temperature acquisition part 613 becomes a temperature lower than the temperature dropping time threshold temperature from a temperature higher than the temperature dropping time threshold temperature, that is, when the temperature acquired by the temperature acquisition part 613 becomes a temperature lower than −10° C. from a temperature equal to or higher than −10° C., the control part 614 instructs the Low voltage switching part 610 to switch a VGL set voltage from −8V to −10V in response to a VGL shift voltage (−2V) set by the above-mentioned VGLSFT storing part 604 so that the Low voltage switching part 610 switches a voltage of the Low voltage line $V_{GL}$ from −8V to −10V.

Further, the control part 614 instructs the High voltage switching part 611 to switch a VGH set voltage from 18V to 19V in response to a VGH shift voltage (+1V) set in the above-mentioned VGHSFT storing part 605 so that the High voltage switching part 611 switches a voltage of the High voltage line $V_{GH}$ from 18V to 19V.

Figure 7A:
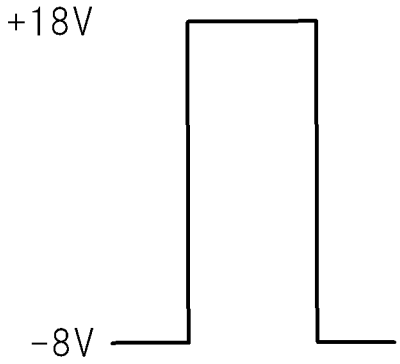
FIG. 7A is a view showing a width of amplitude between a voltage of a low voltage line $V_{GL}$ and a voltage of a high voltage line $V_{GH}$ when a temperature is higher than a temperature dropping time threshold temperature in the embodiment of the present invention.
Figure 7B:
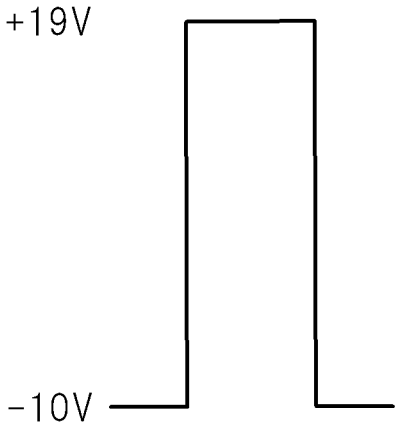
FIG. 7B is a view showing the width of amplitude between the voltage of the low voltage line $V_{GL}$ and the voltage of the high voltage line $V_{GH}$ when the temperature becomes lower than the temperature dropping time threshold temperature in the embodiment of the present invention.

That is, as shown in FIG. 7B, when the temperature becomes lower than the temperature dropping time threshold temperature, the control part 614 increases a width of amplitude between the voltage of the Low voltage line $V_{GL}$ and the voltage of the High voltage line $V_{GH}$. That is, FIG. 7A shows the width of amplitude when the temperature is higher than −10° C., and FIG. 7B shows the width of amplitude when the temperature is equal to or lower than −10° C. In this manner, the display device 100 of this embodiment can prevent an ON current of the transistor T1 included in the shift register circuit 104 from decreasing at a low temperature by increasing the amplitude of the voltage of a control signal 115 from the driver 106. In addition to the above-mentioned advantageous effect, amplitude of a voltage of the base signal $V_n$ inputted from the input terminal IN1 in FIG. 4 is also increased and hence, a more proper gate signal $G_n$ is supplied to the basic circuit 113.

On the other hand, when a temperature acquired by the temperature acquisition part 613 becomes a temperature higher than the temperature rising time threshold temperature from a temperature lower than the temperature rising time threshold temperature, that is, when the temperature becomes a temperature equal to or more than −5° C. from a temperature lower than −5° C., for example, the control part 614 instructs the Low voltage switching part 610 to switch a VGL set voltage from −10V to −8V so that the Low voltage switching part 610 switches the voltage of the Low voltage line $V_{GL}$ from −10V to −8V. Further, the control part 614 instructs the High voltage switching part 611 to switch a VGH set voltage from 19V to 18V so that the High voltage switching part 611 switches the voltage of the High voltage line $V_{GH}$ from 19V to 18V.

That is, when the temperature becomes a temperature equal to or more than the temperature rising time threshold temperature, the control part 614 returns the setting of the voltage of the Low voltage line $V_{GL}$ and the voltage of the High voltage line $V_{GH}$ to the state that was before switching. Due to such an operation, it is possible to prevent a case where the setting of the voltage of the Low voltage line $V_{GL}$ and the voltage of the High voltage line $V_{GH}$ is held in low temperature time setting when a temperature rises again.

As described above, by switching the amplitude of the voltage of the Low voltage line and/or the amplitude of the voltage of the High voltage line with respect to the gate control line based on the temperature information, it is possible to provide a control device for a display device which can supply proper gate signals particularly at a low temperature.

This embodiment is not limited to the constitution shown in FIG. 6, and may be variously modified. For example, the constitution of this embodiment can be replaced with a constitution which is substantially equal to the constitution shown in FIG. 6 which can acquire substantially the same manner of operation and advantageous effects as the constitution shown in FIG. 6, or which can acquire the same object as the constitution shown in FIG. 6.

[Modification]

Figure 8:
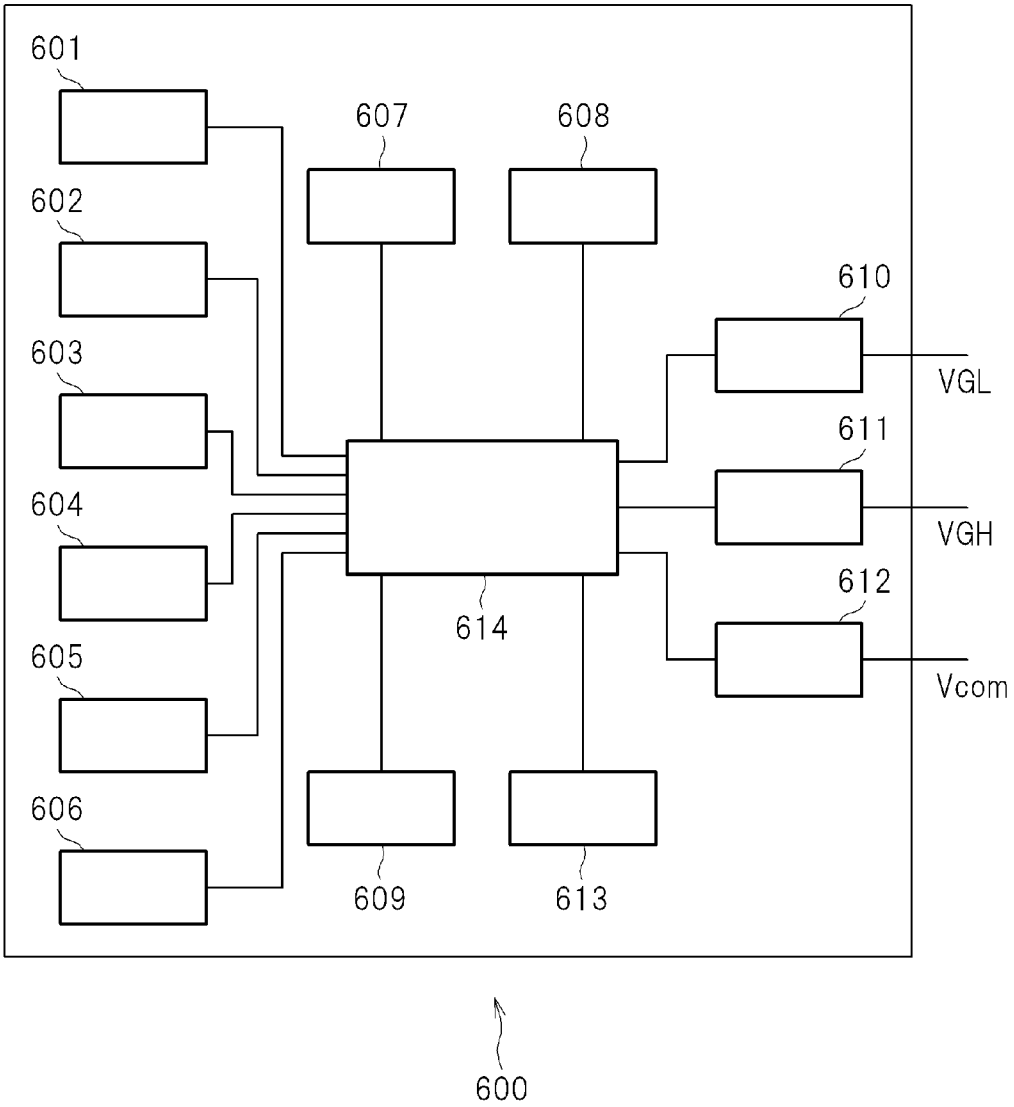
FIG. 8 is a block diagram for explaining a modification of the embodiment of the present invention.

FIG. 8 is a view for explaining a modification of the present invention. This modification differs from the above-mentioned embodiment in that the voltage switching part 600 further includes a VCM storing part 603, an SFTC storing part 606, and a common voltage switching part 612 which are respectively connected to the control part 614. Parts other than the above-mentioned parts are substantially equal the corresponding parts of the above-mentioned embodiment and hence, the substantially equal parts are not explained hereinafter.

The VCM storing part 603 stores a set voltage ($V_{COM}$ voltage) of a common signal line 108, and outputs the $V_{COM}$ voltage to the control part 614. For example, as shown in Table 8, the VCM storing part 603 stores set voltages of a plurality of common signal lines 108, the set voltages of the plurality of common signal lines 108 respectively correspond to the respective register values. Which set voltage of the common signal line 108 is to be selected from the set voltages of the common signal lines 108 is determined at the time of shipping a product from a factory by selecting the register value from the above-mentioned respective register values, for example. Further, for example, in Table 8, the register value 7'h86 corresponds to the $V_{COM}$ voltage −0.510V.

TABLE 8

| VCM register | Vcom voltage |
|---|---|
| 7'h00 to 3F | setting inhibited |
| 7'h40 | 0.540 V |
| 7'h41 | 0.525 V |
| 7'h42 | 0.510 V |
| 7'h43 | 0.495 V |
| 7'h44 | 0.480 V |
| 7'h45 | 0.465 V |
| 7'h46 | 0.450 V |
| 7'h47 | 0.435 V |
| 7'h48 | 0.420 V |
| 7'h49 | 0.405 V |
| 7'h4A | 0.390 V |
| 7'h4B | 0.375 V |
| 7'h4C | 0.360 V |
| 7'h4D | 0.345 V |
| 7'h4E | 0.330 V |
| 7'h4F | 0.315 V |
| 7'h50 | 0.300 V |
| 7'h51 | 0.285 V |
| 7'h52 | 0.270 V |
| 7'h53 | 0.255 V |
| 7'h54 | 0.240 V |
| 7'h55 | 0.225 V |

TABLE 8-continued

| VCM register | Vcom voltage |
|---|---|
| 7'h56 | 0.210 V |
| 7'h57 | 0.195 V |
| 7'h58 | 0.180 V |
| 7'h59 | 0.165 V |
| 7'h5A | 0.150 V |
| 7'h5B | 0.135 V |
| 7'h5C | 0.120 V |
| 7'h5D | 0.105 V |
| 7'h5E | 0.090 V |
| 7'h5F | 0.075 V |
| 7'h60 | 0.060 V |
| 7'h61 | 0.045 V |
| 7'h62 | 0.030 V |
| 7'h63 | 0.015 V |
| 7'h64 | 0.000 V |
| 7'h65 | −0.015 V |
| 7'h66 | −0.030 V |
| 7'h67 | −0.045 V |
| 7'h68 | −0.060 V |
| 7'h69 | −0.075 V |
| 7'h6A | −0.090 V |
| 7'h6B | −0.105 V |
| 7'h6C | −0.120 V |
| 7'h6D | −0.135 V |
| 7'h6E | −0.150 V |
| 7'h6F | −0.165 V |
| 7'h70 | −0.180 V |
| 7'h71 | −0.195 V |
| 7'h72 | −0.210 V |
| 7'h73 | −0.225 V |
| 7'h74 | −0.240 V |
| 7'h75 | −0.255 V |
| 7'h76 | −0.270 V |
| 7'h77 | −0.285 V |
| 7'h78 | −0.300 V |
| 7'h79 | −0.315 V |
| 7'h7A | −0.330 V |
| 7'h7B | −0.345 V |
| 7'h7C | −0.360 V |
| 7'h7D | −0.375 V |
| 7'h7E | −0.390 V |
| 7'h7F | −0.405 V |
| 7'h80 | −0.420 V |
| 7'h81 | −0.435 V |
| 7'h82 | −0.450 V |
| 7'h83 | −0.465 V |
| 7'h84 | −0.480 V |
| 7'h85 | −0.495 V |
| 7'h86 | −0.510 V |
| 7'h87 | −0.525 V |
| 7'h88 | −0.540 V |
| 7'h89 | −0.555 V |
| 7'h8A | −0.570 V |
| 7'h8B | −0.585 V |
| 7'h8C | −0.600 V |
| 7'h8D | −0.615 V |
| 7'h8E | −0.630 V |
| 7'h8F | −0.645 V |
| 7'h90 | −0.660 V |
| 7'h91 | −0.675 V |
| 7'h92 | −0.690 V |
| 7'h93 | −0.705 V |
| 7'h94 | −0.720 V |
| 7'h95 | −0.735 V |
| 7'h96 | −0.750 V |
| 7'h97 | −0.765 V |
| 7'h98 | −0.780 V |
| 7'h99 | −0.795 V |
| 7'h9A | −0.810 V |
| 7'h9B | −0.825 V |
| 7'h9C | −0.840 V |
| 7'h9D | −0.855 V |
| 7'h9E | −0.870 V |
| 7'h9F | −0.885 V |
| 7'hA0 | −0.900 V |
| 7'hA1 | −0.915 V |
| 7'hA2 | −0.930 V |

TABLE 8-continued

| VCM register | Vcom voltage |
|---|---|
| 7'hA3 | −0.945 V |
| 7'hA4 | −0.960 V |
| 7'hA5 | −0.975 V |
| 7'hA6 | −0.990 V |
| 7'hA7 | −1.005 V |
| 7'hA8 | −1.020 V |
| 7'hA9 | −1.035 V |
| 7'hAA | −1.050 V |
| 7'hAB | −1.065 V |
| 7'hAC | −1.080 V |
| 7'hAD | −1.095 V |
| 7'hAE | −1.110 V |
| 7'hAF | −1.125 V |
| 7'hB0 | −1.140 V |
| 7'hB1 | −1.155 V |
| 7'hB2 | −1.170 V |
| 7'hB3 | −1.185 V |
| 7'hB4 | −1.200 V |
| 7'hB5 | −1.215 V |
| 7'hB6 | −1.230 V |
| 7'hB7 | −1.245 V |
| 7'hB8 | −1.260 V |
| 7'hB9 | −1.275 V |
| 7'hBA | −1.290 V |
| 7'hBB | −1.305 V |
| 7'hBC | −1.320 V |
| 7'hBD | −1.335 V |
| 7'hBE | −1.350 V |
| 7'hBF | −1.365 V |
| 7'hC0 | −1.380 V |
| 7'hC1 | −1.395 V |
| 7'hC2 | −1.410 V |
| 7'hC3 | −1.425 V |
| 7'hC4 | −1.440 V |
| 7'hC5 | −1.455 V |
| 7'hC6 | −1.470 V |
| 7'hC7 | −1.485 V |
| 7'hC8 | −1.500 V |
| 7'hC9 to FF | setting inhibited |

The SFTC storing part 606 stores a change of voltage ($V_{COM}$ shift voltage) of the common signal line 108 when the temperature acquired by the temperature acquisition part 613 becomes lower than the temperature dropping time threshold temperature, and outputs the $V_{COM}$ shift voltage to the control part 614. For example, as shown in Table 9, the SFTC storing part 606 stores changes of voltages of a plurality of common signal lines 108, and the changes of the voltages of the plurality of common signal lines 108 correspond to the respective register values respectively. For example, in Table 9, a resister value 4'hB corresponds to a set $V_{COM}$ voltage of −0.495V, that is, a temperature obtained by moving a temperature corresponding to the selected $V_{COM}$ register value by −33 steps in the row direction.

TABLE 9

| SFTC register | Vcom shift voltage | Vcom adjustment register shift value |
|---|---|---|
| 4'h0 | 0 mV | no shift |
| 4'h1 | −45 mV | −3 steps |
| 4'h2 | −90 mV | −6 steps |
| 4'h3 | −135 mV | −9 steps |
| 4'h4 | −180 mV | −12 steps |
| 4'h5 | −225 mV | −15 steps |
| 4'h6 | −270 mV | −18 steps |
| 4'h7 | −315 mV | −21 steps |
| 4'h8 | −360 mV | −24 steps |
| 4'h9 | −405 mV | −27 steps |
| 4'hA | −450 mV | −30 steps |
| 4'hB | −495 mV | −33 steps |

TABLE 9-continued

| SFTC register | Vcom shift voltage | Vcom adjustment register shift value |
|---|---|---|
| 4'hC | −540 mV | −36 steps |
| 4'hD | −585 mV | −39 steps |
| 4'hE | −630 mV | −42 steps |

Which change of voltage of the common signal line 108 is to be selected from the changes of voltages of the plurality of common signal lines 108 is determined at the time of shipping a product from a factory by selecting the register value from the above-mentioned respective register values, for example. Further, as the changes of voltages of the plurality of common signal lines 108, specific values may be stored as indicated in a second column in Table 9. Further, as the changes of voltages of the plurality of common signal lines 108, changes (the number of steps) in the row direction from the selected VCOM register value may be stored. Further, the $V_{COM}$ shift voltage corresponds to a common shift voltage described in claims.

The common voltage switching part 612 switches a voltage of the common signal line 108 in response to a common voltage control signal from the control part 614, and outputs the common voltage obtained by switching to the common signal line 108.

Next, the manner of operation of this modification is explained. In this modification, an optimum value of a common voltage set with reference to a jump voltage at a normal temperature is changed to an optimum value of the common voltage in which the jump voltage at a low temperature is taken into consideration. The optimum value of the common voltage at each temperature is set as a value with which no flickers are generated on a display screen at a normal temperature.

Here, the jump voltage is a voltage which is generated due to a width of amplitude between a voltage of the low voltage line $V_{GL}$ and a voltage of a high voltage line $V_{GH}$ and a parasitic capacity of a panel. To be more specific, for example, a parasitic capacity Cgs exists between a source and a gate of the TFT 109 shown in FIG. 2, and a holding capacity Cstg exists between a pixel electrode and a common electrode so that a jump voltage of $Cgs/(Cstg+Cgs)\times(V_{GH}-V_{GL})$ is generated. Accordingly, for example, as shown in FIG. 7, when the width of amplitude between the voltage of the low voltage line $V_{GL}$ and the voltage of a high voltage line $V_{GH}$ at a normal temperature is set to 26V, and when the width of amplitude at a low temperature is set to 29V, the jump voltage at a low temperature becomes large compared to the jump voltage at a normal temperature. An optimum value of a common voltage at a normal temperature is set in conformity with a jump voltage at a normal temperature and hence, when a jump voltage becomes large at a low temperature with the common voltage unchanged, flickers may be generated. Accordingly, in this modification, an optimum value of a common voltage set at a normal temperature is changed to an optimum value of the common voltage in which the jump voltage at a low temperature is taken into consideration.

To be more specific, in addition to the setting performed in the above-mentioned embodiment, the explanation is made hereinafter using a case where a common voltage at a normal temperature is set to −0.51V ($V_{com}$ register value being 7'h86) and a $V_{com}$ shift voltage is set to −495 mV (+33 steps).

When the temperature acquired by the temperature acquisition part 613 becomes a temperature lower than a temperature dropping time threshold temperature from a temperature higher than a temperature dropping time threshold temperature, that is, when the temperature becomes a temperature equal to or lower than −10° C. from a temperature higher than −10° C., the control part 614 instructs the common voltage switching part 612 to switch a $V_{com}$ set voltage from −0.51V to −1.005V based on Table 8 and Table 9 so that the common voltage switching part 612 switches a voltage of the common signal line 108 from −0.510V to −1.005V. Even when the temperature rises again, for example, even when the temperature acquired by the temperature acquisition part 613 becomes a temperature higher than the temperature rising time threshold temperature, the common set voltage is returned to the set voltage before temperature dropping in the same manner.

As described above, according to this modification, by switching over the voltage amplitude of the Low voltage line and/or the voltage amplitude of the High voltage line with respect to a gate control signal based on temperature information, it is possible to provide a control circuit for a display device which can supply a proper gate signal particularly at a low temperature. Further, by switching a voltage of a common signal line 108 in addition to voltage amplitudes of the High voltage line and the Low voltage line, value of a common voltage can be changed to an optimum value of the common voltage by taking a jump voltage into consideration as described above and thus quality of a display screen is further improved.

This modification is not limited to the constitution shown in FIG. 8, and can be modified variously. For example, the constitution of this modification can be replaced with the constitution which is substantially equal to the constitution shown in FIG. 8, which can acquires the same manner of operation and advantageous effects as the constitution shown in FIG. 8, or which can acquire the same object as the constitution shown in FIG. 8.

Further, in the above-mentioned embodiment or modification, the driver 106 may be configured to supply a GND precharge voltage and a Vci precharge voltage described later to the video signal line 107. To be more specific, for example, the driver 106 may include a precharge voltage supply drive circuit (not shown in the drawing) which performs a GND precharge and a Vci precharge based on pixel data. Here, it is assumed that a so-called dot inversion method is used as the above-mentioned driving method of the display device 100. Further, pixel data explained hereinafter corresponds to a video signal supplied to the video signal line 107 from the driver 106.

Here, the GND precharge is, for example, as shown in FIG. 9A to FIG. 9F, an operation to change a voltage of a video signal line 107 to a voltage of a GND when a display of a pixel is changed from a white display to a black display. According to this GND precharge, a voltage can be changed using the voltage of the GND which is not measured as power consumption instead of driving by a video signal line 107 which is measured as power consumption and hence, the power consumption can be decreased.

On the other hand, the Vci precharge is an operation to apply a voltage corresponding to a video signal to a video signal line 107 using a Vci precharge voltage that is a voltage equal to or lower than a voltage for displaying a white or black and that is supplied by a precharge voltage supply drive circuit, after the above-mentioned GND precharge is performed. To be more specific, for example, when a normally black panel is used and when a voltage for displaying white is −5V or +5V, a voltage corresponding to a video signal is applied to the video signal line 107 using the precharge voltage supply drive circuit that supplies a Vci precharge voltage of approximately −2.5V or +2.5V, which is approximately half of the voltage of −5V or +5V, after the above-mentioned GND precharge is performed.

Figure 9A:
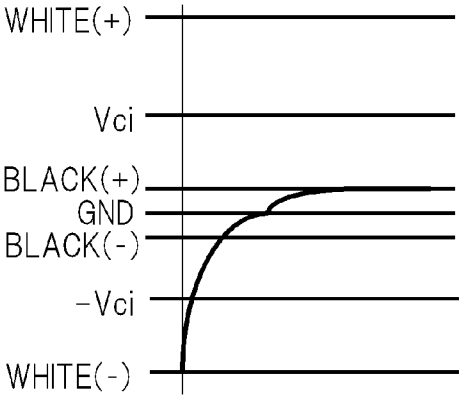
FIG. 9A is a view for explaining a precharge operation in the embodiment or in the modification of the present invention.
Figure 9B:
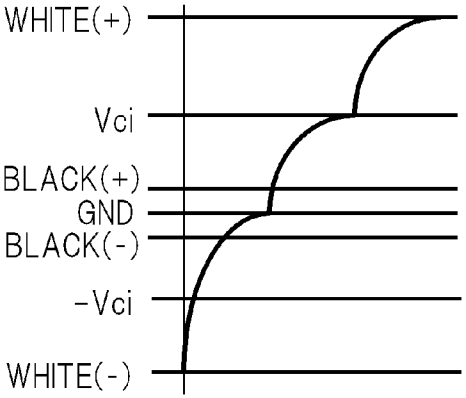
FIG. 9B is a view for explaining a precharge operation in the embodiment or in the modification of the present invention.
Figure 9C:
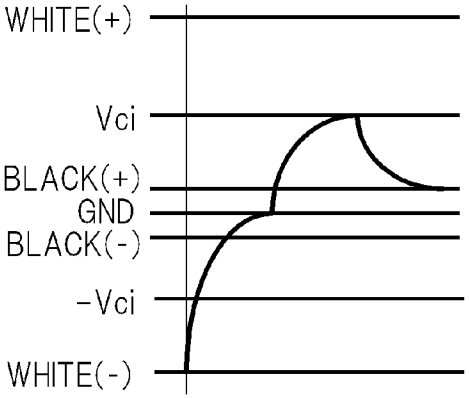
FIG. 9C is a view for explaining a precharge operation in the embodiment or in the modification of the present invention.
Figure 9D:
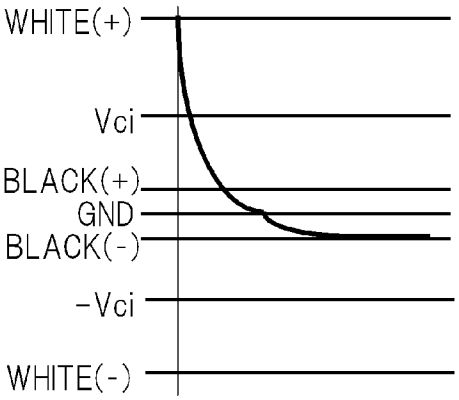
FIG. 9D is a view for explaining a precharge operation in the embodiment or in the modification of the present invention.
Figure 9E:
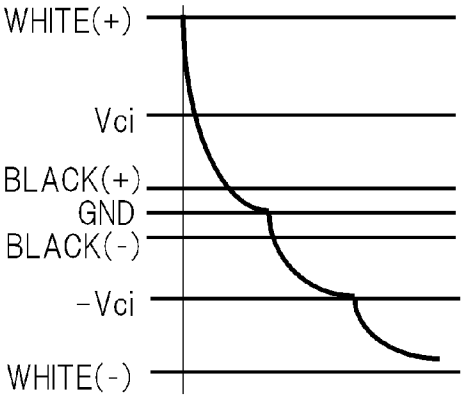
FIG. 9E is a view for explaining a precharge operation in the embodiment or in the modification of the present invention.
Figure 9F:
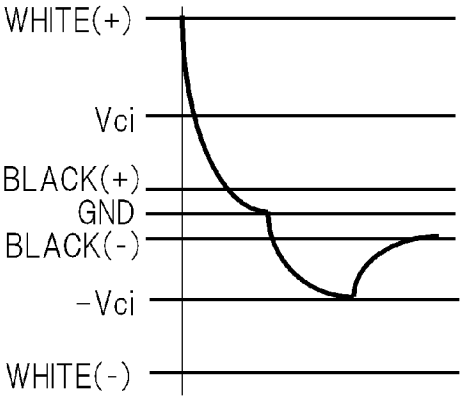
FIG. 9F is a view for explaining a precharge operation in the embodiment or in the modification of the present invention.

Further, turning on or off of the Vci precharge can be selected based on image data. To be more specific, for example, as shown in FIG. 9A to FIG. 9F, the explanation is made with respect to a case where gradation values of pixel data are constituted of 8 bits. FIG. 9A to FIG. 9C show a waveform of an output supplied to the video signal line 107 from the driver 106 when pixel data is changed from a negative pole to a positive pole. FIG. 9D to FIG. 9F show a waveform of an output supplied to the video signal line 107 from the driver 106 when pixel data is changed from a positive pole to a negative pole.

As shown in FIG. 9A to FIG. 9D, for example, when a value of a most significant bit is changed from 1 to 0 and when a video signal D [7:0] is changed from a negative pole 11111111 (white) to a positive pole 00000000 (black), the Vci precharge is turned off. When the Vci precharge is in an OFF state, a voltage corresponding to a video signal is applied to a video signal line 107 using a voltage for displaying white, for example, −5V or +5V. On the other hand, as shown in FIG. 9B and FIG. 9E, when the value of the most significant bit is not changed from 1, for example, when the pixel data D[7:0] is changed from a negative pole 11111111 (white) to a positive pole 11111111 (white), the Vci precharge is turned on.

That is, depending on whether a gradation value of a pixel is higher or lower than a certain threshold value, for example, approximately 128, turning on/off of the Vci precharge voltage operation is switched. A threshold value of the gradation value of the pixel may be adjusted based on characteristics or the like of a liquid crystal display panel.

Accordingly, each pixel can be driven with lower power consumption compared with a case where the GND precharge and the Vci precharge are always performed as shown in FIG. 9C and FIG. 9F.

The present invention is not limited to the above-mentioned embodiment and modification, and can be modified variously. For example, the constitution of the embodiment or the modification can be replaced with the constitution which is substantially equal to the constitution of the embodiment or the modification, which can acquire substantially the same manner of operation and advantageous effects as the constitution of the embodiment or the modification, or which can acquire substantially the same object as the constitution of the embodiment or the modification.

Further, a control circuit for a display device described in claims corresponds to the driver 106 and the shift register circuit 104 in the display device 100 described in the embodiment or the modification.

What is claimed is:

1. A control circuit for a display device comprising:

a shift register circuit which includes at least one transistor and outputs a gate signal in response to at least one voltage signal;

a temperature information acquisition unit configured to acquire temperature information at the control circuit for a display device;

a voltage switching unit configured to switch a voltage of the at least one voltage signal based on the acquired temperature information;

a first threshold value storing unit configured to store a first threshold temperature, and a second threshold value storing unit configured to store a second threshold temperature which is different from the first threshold temperature;

wherein the voltage switching unit switches a temperature dropping time voltage of the at least one voltage signal when the acquired temperature information indicates that a temperature becomes a temperature lower than the first threshold temperature from a temperature higher than the first threshold temperature, wherein the voltage switching unit switches a temperature rising time voltage of the at least one voltage signal when the acquired temperature information indicates that a temperature becomes a temperature higher than the second threshold temperature from a temperature lower than the second threshold temperature, wherein the voltage switching unit does not switch the temperature rising time voltage when the acquired temperature information indicates that a temperature becomes a temperature higher than the first threshold temperature from a temperature lower than the first threshold temperature, and wherein the voltage switching unit does not switch the temperature dropping time voltage when the acquired temperature information indicates that a temperature becomes a temperature lower than the second threshold temperature from a temperature higher than the second threshold temperature.

2. The control circuit for a display device according to claim 1, further comprising a shift voltage storing unit configured to store a shift voltage, wherein the voltage switching unit switches the voltage of the at least one voltage signal to a voltage that is changed from the voltage of the at least one voltage signal by an amount of the shift voltage.

3. The control circuit for a display device according to claim 1, wherein the voltage signal comprises a voltage signal of a Low voltage line.

4. The control circuit for a display device according to claim 1, wherein the voltage signal comprises a voltage signal of a High voltage line.

5. The control circuit for a display device according to claim 1, wherein the at least one voltage signal comprises a voltage signal of a Low voltage line and a voltage signal of a High voltage line, and wherein the voltage switching unit switches the voltage of the at least one voltage signal such that a voltage of the voltage signal of the Low voltage line is lowered and a voltage of the voltage signal of the High voltage line is elevated when the acquired temperature information indicates that the temperature becomes the temperature lower than the first threshold temperature from the temperature higher than the first threshold temperature.

6. The control circuit for a display device according to claim 5, wherein the voltage switching unit respectively switches the voltage of the voltage signal of the Low voltage line and the voltage of the voltage signal of the High voltage line to the voltage of the voltage signal of the Low voltage line outputted before switching and the voltage of the voltage signal of the High voltage line outputted before switching when the acquired temperature information indicates that the temperature becomes the temperature higher than the second threshold temperature from the temperature lower than the second threshold temperature.

7. The control circuit for a display device according to claim 1, further comprising a common voltage switching unit configured to switch a voltage of a common signal line in a pixel region based on the acquired temperature information.

8. The control circuit for a display device according to claim 7, wherein the common voltage switching unit switches a voltage of the common signal line when the acquired temperature information indicates that the temperature becomes the temperature lower than the first threshold temperature from the temperature higher than the first threshold temperature.

9. The control circuit for a display device according to claim 8, wherein the common voltage switching unit switches the voltage of the common signal line to the voltage of the common signal line outputted before switching the voltage of the common signal line when the acquired temperature information indicates that the temperature becomes the temperature higher than the second threshold temperature from the temperature lower than the second threshold temperature.

10. The control circuit for a display device according to claim 7, further comprising a common shift voltage storing unit which stores a common shift voltage of the common signal line, wherein the common voltage switching unit switches the voltage of the common voltage signal to a voltage which is changed from the voltage of the common voltage signal by an amount corresponding to the common shift voltage.

* * * * *